US008849669B2

(12) United States Patent
Bakis et al.

(10) Patent No.: US 8,849,669 B2
(45) **Date of Patent: *Sep. 30, 2014**

(54) SYSTEM FOR TUNING SYNTHESIZED SPEECH

(71) Applicant: Nuance Communications, Inc., Burlington, MA (US)

(72) Inventors: Raimo Bakis, Briarcliff Manor, NY (US); Ellen Marie Eide, New York, NY (US); Roberto Pieraccini, Peekskill, NY (US); Maria E. Smith, Davie, FL (US); Jie Z. Zeng, Palmetto Bay, FL (US)

(73) Assignee: Nuance Communications, Inc., Burlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/855,813

(22) Filed: Apr. 3, 2013

(65) Prior Publication Data

US 2014/0058734 A1 Feb. 27, 2014

Related U.S. Application Data

(63) Continuation of application No. 11/621,347, filed on Jan. 9, 2007, now Pat. No. 8,438,032.

(51) Int. Cl.

| | |
|---|---|
| ***G10L 13/06*** | (2013.01) |
| ***G10L 13/033*** | (2013.01) |
| ***G10L 13/08*** | (2013.01) |

(52) U.S. Cl.

CPC ..... *G10L 13/08* (2013.01); *G10L 13/033* (2013.01)

USPC ..... 704/266

(58) Field of Classification Search

USPC ..... 704/258–269

See application file for complete search history.

(56) References Cited

U.S. PATENT DOCUMENTS

| | | | | |
|---|---|---|---|---|
| 4,779,209 | A * | 10/1988 | Stapleford et al. | 704/278 |
| 5,850,629 | A * | 12/1998 | Holm et al. | 704/260 |
| 5,875,448 | A * | 2/1999 | Boys et al. | 715/201 |
| 6,006,187 | A * | 12/1999 | Tanenblatt | 704/260 |
| 6,101,470 | A | 8/2000 | Eide et al. | |
| 6,226,614 | B1 | 5/2001 | Mizuno et al. | |
| 6,446,040 | B1 * | 9/2002 | Socher et al. | 704/260 |
| 6,665,641 | B1 | 12/2003 | Coorman et al. | |
| 6,829,581 | B2 | 12/2004 | Meron | |
| 6,963,839 | B1 * | 11/2005 | Ostermann et al. | 704/260 |
| 7,103,548 | B2 * | 9/2006 | Squibbs et al. | 704/260 |
| 7,644,000 | B1 * | 1/2010 | Strom | 704/278 |
| 8,504,368 | B2 * | 8/2013 | Katae et al. | 704/260 |
| 2002/0072909 | A1 | 6/2002 | Eide et al. | |
| 2002/0188449 | A1 | 12/2002 | Nukaga et al. | |
| 2003/0163314 | A1 * | 8/2003 | Junqua | 704/260 |
| 2004/0107101 | A1 * | 6/2004 | Eide | 704/260 |
| 2005/0038657 | A1 * | 2/2005 | Roth et al. | 704/260 |
| 2005/0071163 | A1 * | 3/2005 | Aaron et al. | 704/260 |

(Continued)

*Primary Examiner* — Douglas Godbold

(74) *Attorney, Agent, or Firm* — Wolf, Greenfield & Sacks, P.C.

(57) ABSTRACT

An embodiment of the invention is a software tool used to convert text, speech synthesis markup language (SSML), and/or extended SSML to synthesized audio. Provisions are provided to create, view, play, and edit the synthesized speech, including editing pitch and duration targets, speaking type, paralinguistic events, and prosody. Prosody can be provided by way of a sample recording. Users can interact with the software tool by way of a graphical user interface (GUI). The software tool can produce synthesized audio file output in many file formats.

20 Claims, 6 Drawing Sheets

(56) References Cited

U.S. PATENT DOCUMENTS

| | | | | |
|---|---|---|---|---|
| 2005/0086060 | A1* | 4/2005 | Gleason et al. | 704/278 |
| 2005/0096909 | A1* | 5/2005 | Bakis et al. | 704/260 |
| 2005/0177369 | A1* | 8/2005 | Stoimenov et al. | 704/260 |
| 2005/0182629 | A1* | 8/2005 | Coorman et al. | 704/266 |
| 2005/0273338 | A1* | 12/2005 | Aaron et al. | 704/267 |
| 2006/0031658 | A1 | 2/2006 | Swanberg et al. | |
| 2006/0224385 | A1* | 10/2006 | Seppala | 704/260 |
| 2006/0259303 | A1 | 11/2006 | Bakis | |
| 2006/0287860 | A1* | 12/2006 | Agapi et al. | 704/260 |
| 2007/0033049 | A1* | 2/2007 | Qin et al. | 704/260 |
| 2007/0055527 | A1* | 3/2007 | Jeong et al. | 704/260 |
| 2008/0027726 | A1* | 1/2008 | Hansen et al. | 704/260 |

* cited by examiner

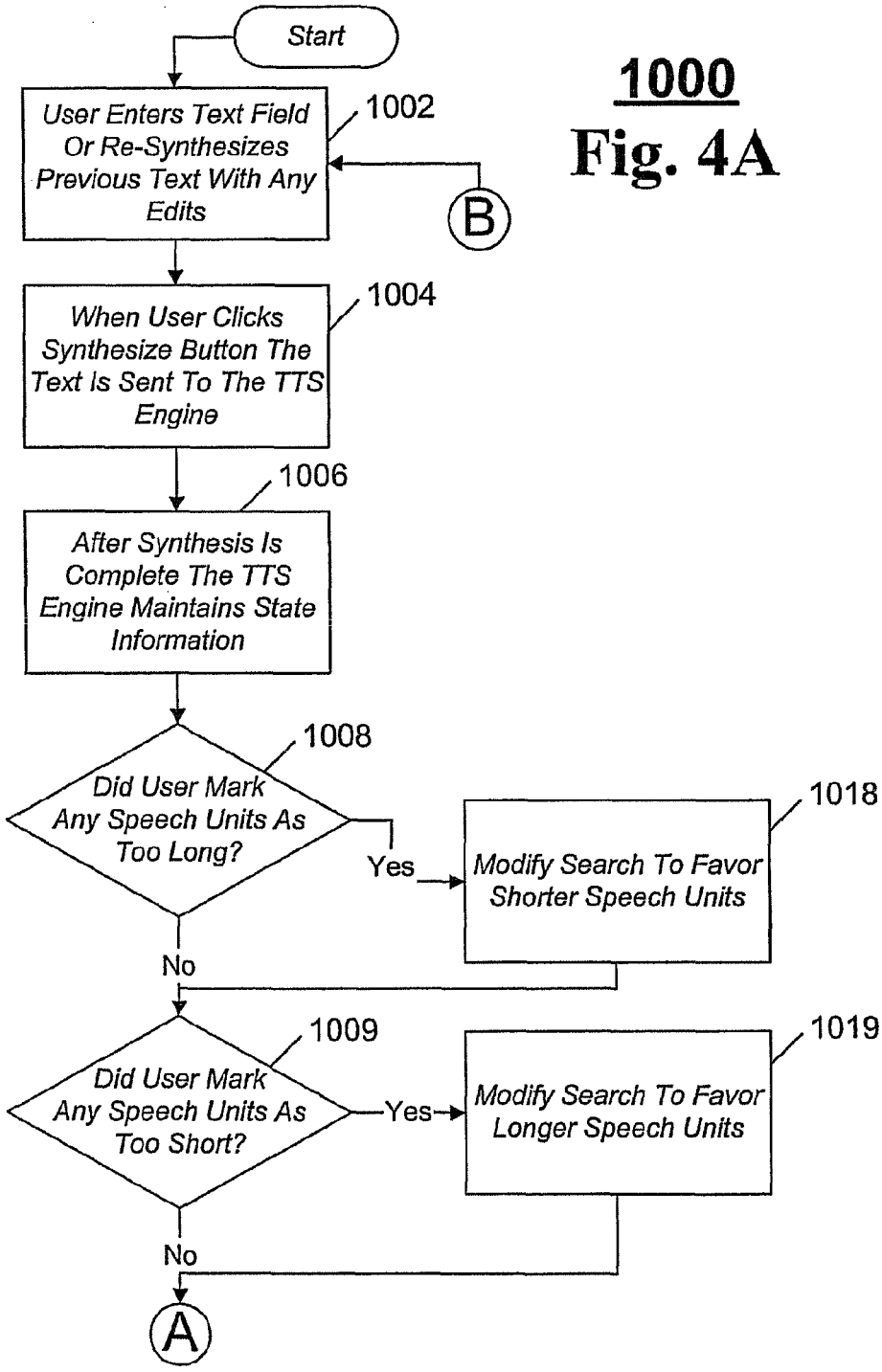
1000
Fig. 4A
Start
User Enters Text Field Or Re-Synthesizes Previous Text With Any Edits
1002
B
When User Clicks Synthesize Button The Text Is Sent To The TTS Engine
1004
After Synthesis Is Complete The TTS Engine Maintains State Information
1006
Did User Mark Any Speech Units As Too Long?
1008
Yes
Modify Search To Favor Shorter Speech Units
1018
No
Did User Mark Any Speech Units As Too Short?
1009
Yes
Modify Search To Favor Longer Speech Units
1019
No
A

1000

2000

SYSTEM FOR TUNING SYNTHESIZED SPEECH

CROSS-REFERENCE TO RELATED APPLICATIONS

This application is a continuation application of U.S. patent application Ser. No. 11/621,347, entitled "System for Tuning Synthesized Speech", filed Jan. 9, 2007, which is hereby incorporated by reference to the maximum extent allowable by law.

This application contains subject matter, which is related to the subject matter of the following applications. Each of the below listed applications is hereby incorporated herein by reference in its entirety:

"SYSTEM AND METHODS FOR TEXT-TO-SPEECH SYNTHESIS USING SPOKEN EXAMPLE", Ser. No. 10/672,374, filed Sep. 26, 2003;

"GENERATING PARALINGUISTIC PHENOMENA VIA MARKUP", U.S. Pat. No. 7,472,065, issued Dec. 30, 2008 (Ser. No. 10/861,055, filed Jun. 4, 2004); and "SYSTEMS AND METHODS FOR EXPRESSIVE TEXT-TO-SPEECH", Ser. No. 10/695,979, filed Oct. 29, 2003.

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to a software tool used to convert text, speech synthesis markup language (SSML), and/or extended SSML to synthesized audio, and particularly to creating, viewing, playing, and editing the synthesized speech including editing pitch and duration targets, speaking type, paralinguistic events, and prosody.

2. Description of Background

Text-to-speech (TTS) systems continue to sometimes produce bad quality audio. For customer applications where much of the text to be synthesized is known and high quality is critical, the sole use of text-to-speech is not optimal.

The most common solution to this problem is to prerecord the application's fixed prompts and frequently synthesized phrases. The use of text-to-speech is then typically limited to the synthesis of dynamic text. This results in a good quality system, but can be very costly due to the use of voice talents and recording studios for the creation of these recordings. This is also impractical because modifications to the prompts depend on the voice talent and studio's availability.

Another drawback is that the voice talent used for prerecording prompts is different than the voice used by the text-to-speech system. This can result in an awkward voice switch in sentences between prerecorded speech and dynamically synthesized speech.

Some systems try to address this problem by enabling customers to interact with the TTS engine to produce an application-specific prompt library. The acoustic editors of some systems enable users to modify the synthesis of the prompt by modifying the target pitch and duration of a phrase. These types of systems overcome frequent problems in synthesized speech, but are limited in solving many types of other problems. For example there is no mechanism for specifying the speaking style, such as apologetic, or for manipulating the pitch contour, adding paralinguistics, or for providing a recording of the prompt from which the system extracts the prosodic parameters.

SUMMARY

The shortcomings of the prior art are overcome and additional advantages are provided by a method of tuning synthesized speech, the method comprising entering a plurality of user supplied text into a text field; clicking a graphical user interface button to send the plurality of user supplied text to a text-to-speech engine; synthesizing the plurality of user supplied text to produce a plurality of speech by way of the text-to-speech engine; maintaining state information related to the plurality of speech; allowing a user to modify a plurality of duration cost factors associated with the plurality of speech to change the duration of the plurality of speech; allowing the user to modify a plurality of pitch cost factors associated with the plurality of speech to change the pitch of the plurality of speech; allowing the user to indicate a plurality of speech units to skip during re-synthesis of the plurality of user supplied text; and re-synthesizing the plurality of speech based on the plurality of user supplied text, the user modified plurality of duration cost factors, the user modified plurality of pitch cost factors, and the user effectuated modifications.

Also shortcomings of the prior art are overcome and additional advantages are provided through the provision of a method of tuning synthesized speech, the method comprising entering a plurality of user supplied text into a text field, said plurality of user supplied text can be text, SSML, and or extended SSML; synthesizing the plurality of user supplied text to produce a plurality of speech by way of a text-to-speech engine; allowing a user to interact with the plurality of speech by viewing the plurality of speech, replaying said plurality of speech, and/or manipulating a waveform associated with the plurality of speech; allowing the user to modify a plurality of duration cost factors of the plurality of speech to change the duration of the plurality of speech; allowing the user to modify a plurality of pitch cost factors of the plurality of speech to change the pitch of the plurality of speech; allowing the user to indicate a plurality of speech units to skip during re-synthesis of the plurality of speech; allowing the user to indicate a plurality of speech units to retain during re-synthesis of the plurality of speech; allowing the user to provide prosody by providing a sample recording; and re-synthesizing the plurality of speech based on the plurality of user supplied text, the user modified plurality of duration cost factors, the user modified plurality of pitch cost factors, and the user effectuated modifications.

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

As a result of the summarized invention, technically we have achieved a solution which overcomes many types of problems associated with text-to-speech software including providing for the ability to specify speaking style, manipulating pitch contour, adding paralinguistics, and specifying prosody by way of a sample recording.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

FIG. 4A-4B illustrates one example of a routine 1000 for inputting user text, synthesizing audio, modifying the speech unit selection process, and re-synthesizing audio as needed.

The detailed description explains the preferred embodiments of the invention, together with advantages and features, by way of example with reference to the drawings.

DETAILED DESCRIPTION

Figure 1:
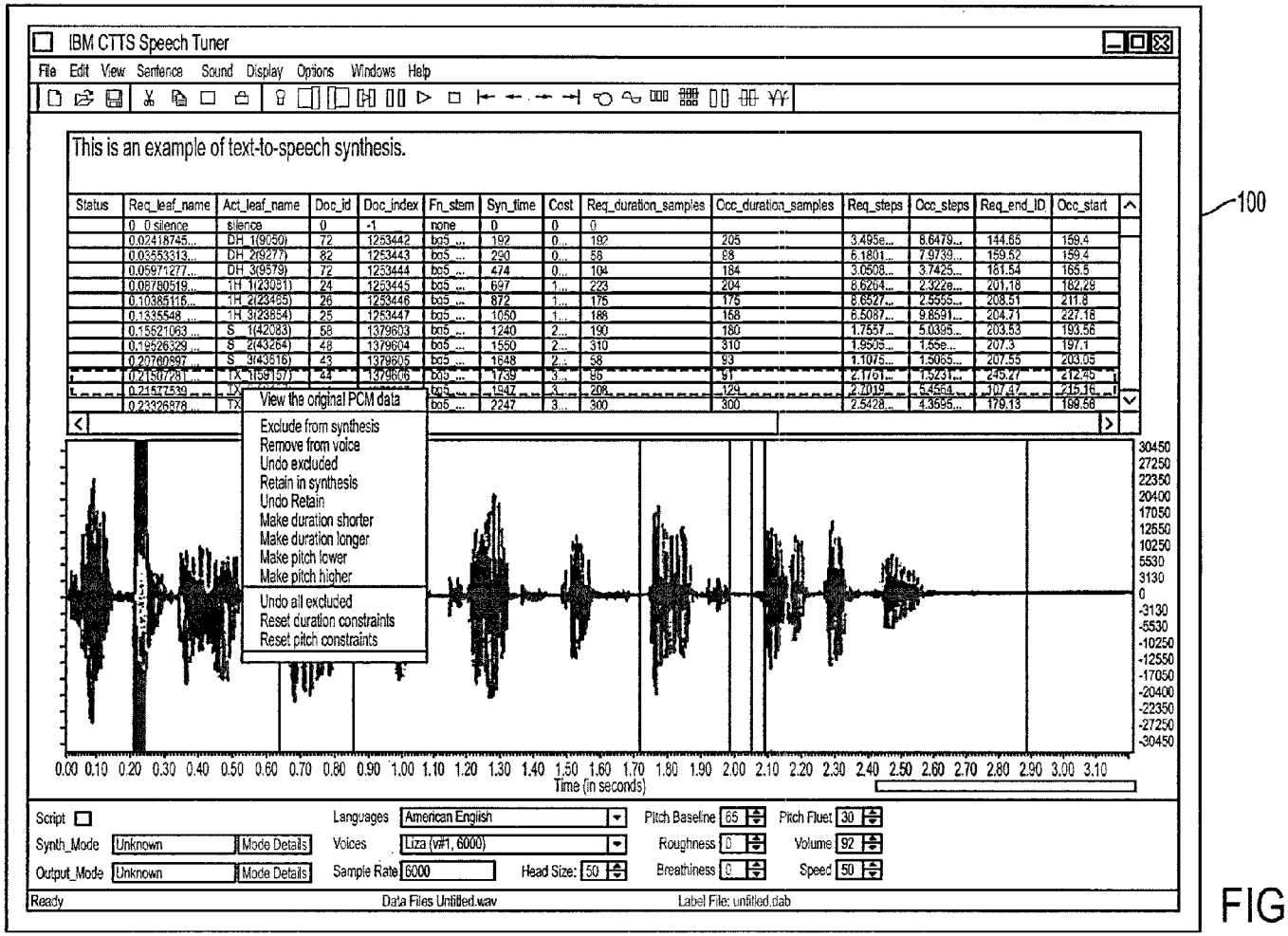
FIG. 1 illustrates one example of a user input and TTS tuner graphical user interface (GUI) screen.

Turning now to the drawings in greater detail, it will be seen that in FIG. 1 there is illustrated one example of a user input and TTS tuner graphical user interface (GUI) screen 100. In an exemplary embodiment, a user can use a software application to refine, manipulate, edit, and/or otherwise change synthesized speech that has been generated with a text-to-speech (TTS) engine based on text, SSML, or extended SSML input.

In this regard, a user can specify input as plain text, speech synthesis markup language (SSML), or extended SSML including new tags such as prosody-style and/or other types and kinds of extended SSML. Users can then view, play, and manipulate the waveform of the synthesized audio, and view tables displaying the data associated with the synthesis, such as pitch, target duration, and/or other types and kinds of data. A user can also modify pitch and duration targets, highlight and select portions of audio/text/data to specify sections of data that are of interest.

A user can then specify speaking styles for the selected audio or text of interest. A user can also modify prosodic targets of sections of audio/text/data that are of interest. A user can also specify speech segments that are not to be used, as well as specify speech segments that are to be retained in a re-synthesis.

In addition, a user can insert paralinguistic events, such as a breath, sigh, and/or other types and kinds of paralinguistic events. The user can modify pitch contour graphically, and specify prosody by providing a sample recording. The user can output an audio file for a specified prompt. The audio file can be played directly by the software application whenever the fixed prompts need to be read to the user.

In another exemplary embodiment an alternative output from the software application can be a specific sequence of segment identifiers and associated information resulting from the tuning of the synthesized audio prompts.

Furthermore, when working with the software application a user does not need to specify full sentence text prompts. In this regard, the text prompts may be fragmented or partial prompts. As an example and not a limitation, an application developer may tune the partial prompt "your flight will be departing at". The playback of this tuned partial prompt will be followed by a synthesized time of day produced by the TTS engine, such as "1 pm".

In an exemplary embodiment, by enabling SSML input into the software application users have a greater control in how the prompt is synthesized. For example, not limitation, users can specify pronunciations, add pauses, specify the type of text through the say-as feature, modify the volume, and/or modify, edit, manipulate, and/or change the synthesized output in other ways.

In another exemplary embodiment, a user can specify a sample recording and the software application will use the user's sample recording to determine prosody of the synthesis. This can allow both an experienced and an inexperienced user to use voice samples to fine tune the software application prosody settings and then apply the settings to other text, SSML, and extended SSML input.

Figure 2:
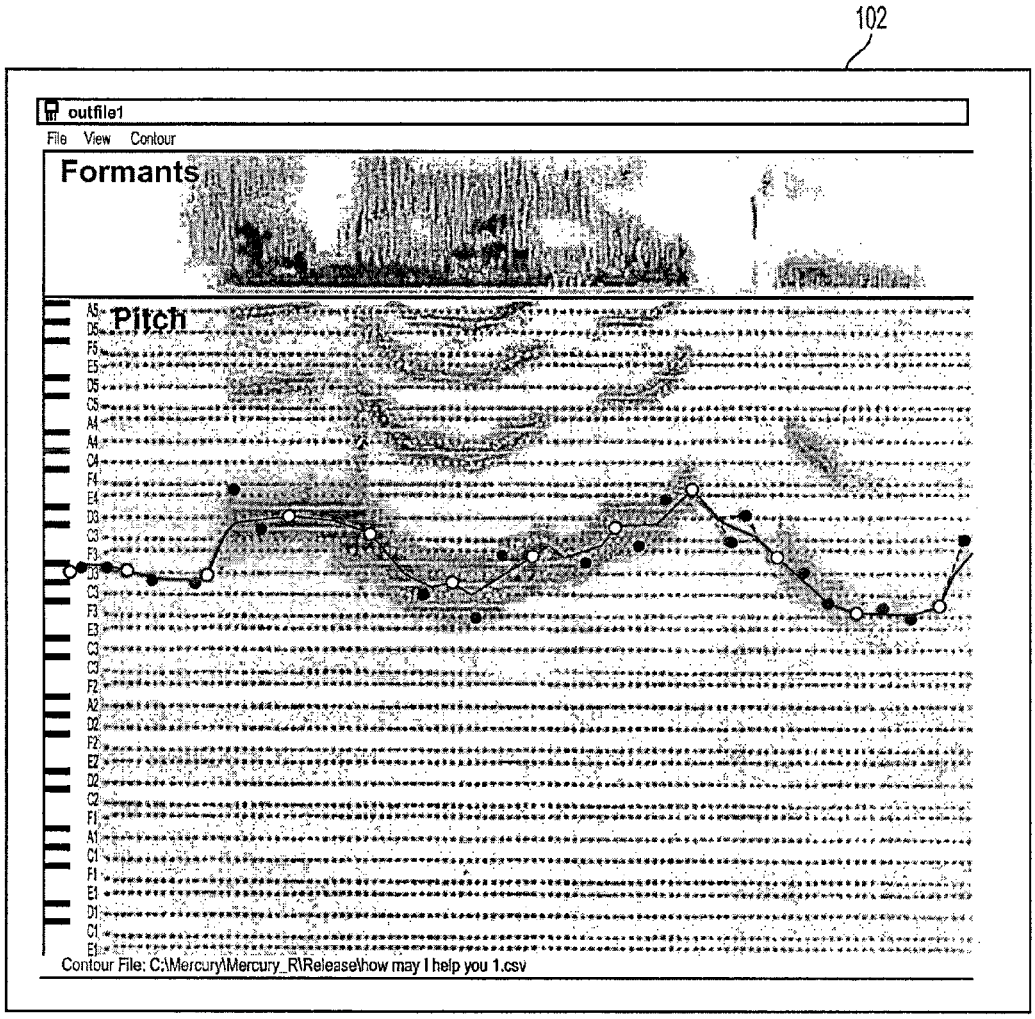
FIG. 2 illustrates one example of a synthesized voice sample, wherein a user can use a graphical user interface screen to view and adjust graphically the pitch.

Referring to FIG. 2, there is illustrated one example of a synthesized voice sample, wherein a user can use a graphical user interface screen 102 for viewing and adjusting graphically the pitch. In an exemplary embodiment the user can adjust the graph to achieve the desired and or required pitch contour. In a plurality of exemplary embodiments, a plurality of other data related to the synthesized voice can be graphically adjusted.

A user can also specify a speaking style by highlighting a section of the graphed data and then selecting the desired and/or required style. This results in the text being converted to SSML with prosody-style tags as one example which is illustrated in FIG. 3.

Figure 3:
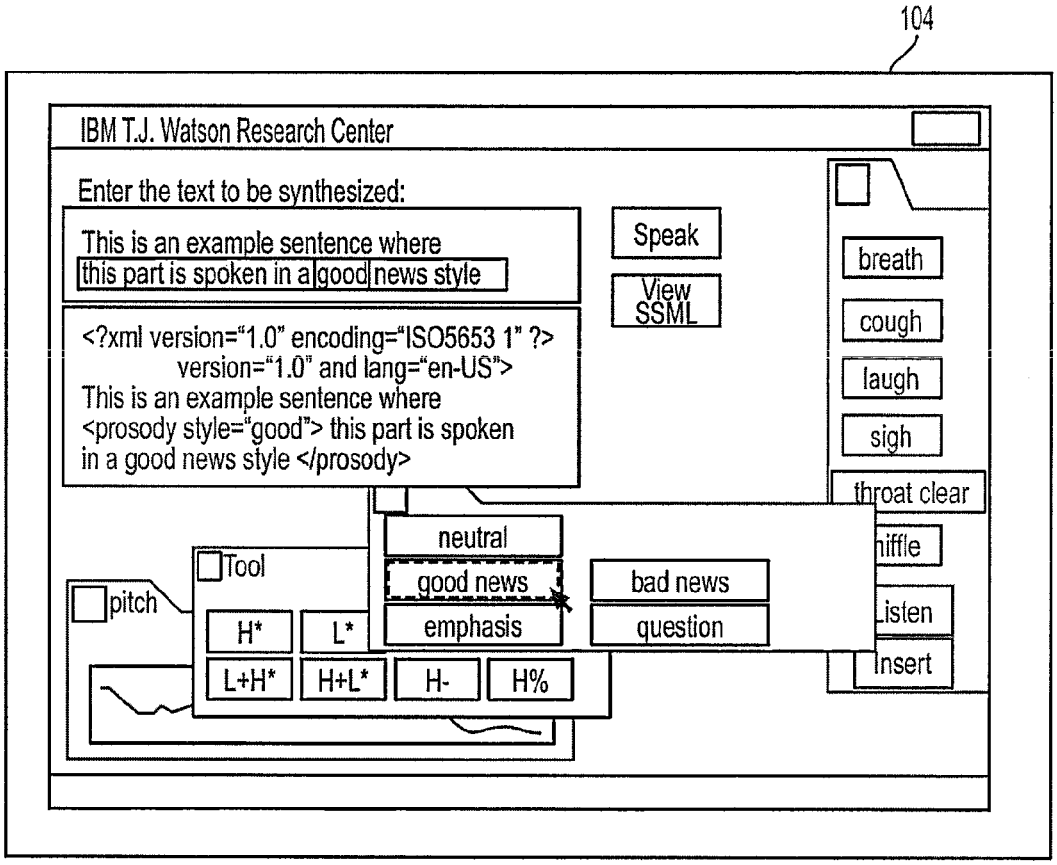
FIG. 3 illustrates one example of a user input and TTS tuner screen, using advanced editing features.

Referring to FIG. 3, there is illustrated one example of a user input and TTS tuner screen 104, using advanced editing features. In an exemplary embodiment, text can be converted to SSML, and or extended SSML where a user can then utilize advanced editing features to specify speaking style, and paralinguistics such as breath, cough, laugh, sigh, throat clear, and sniffle to name a few.

Figure 4B:
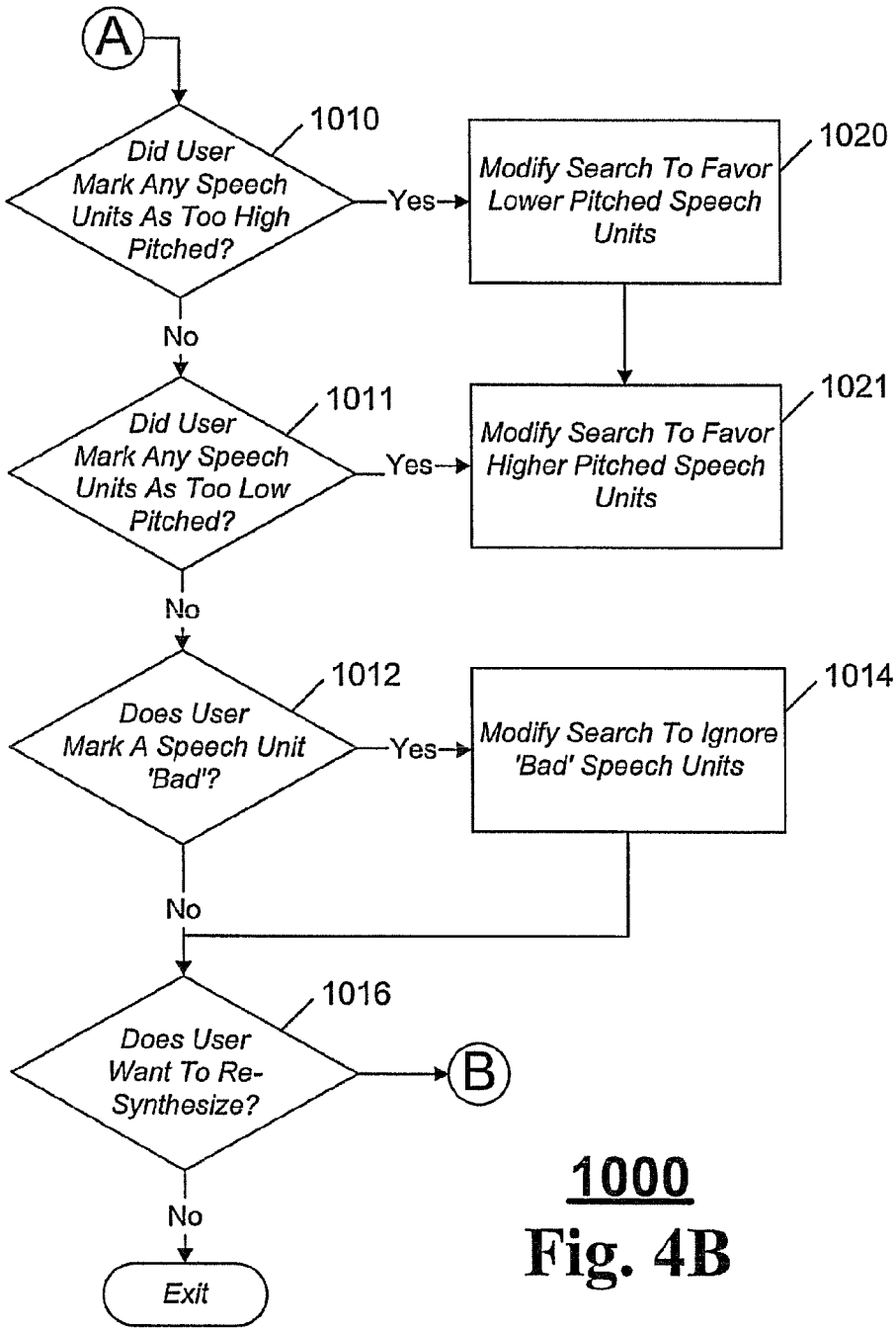

Referring to FIG. 4A-4B, there is illustrated one example of a routine 1000 for inputting user text, synthesizing audio, modifying the speech unit selection process, and re-synthesizing audio as needed. In an exemplary embodiment, a user of the software application can supply text, SSML, and or extended SSML input to the TTS engine. The TTS engine will synthesize the speech and then allow the user to modify the speech unit selection parameters. The user can then exit the routine and use the output file in other applications, or re-synthesize to obtain a new synthesized speech sample with the user's edits, modifications, and/or changes incorporated into the new synthesized speech sample. Processing begins in block 1002.

In block 1002, the graphical user interface (GUI) allows the user to enter text, SSML, and or extended SSML that the user wishes to have the text-to-speech (TTS) engine synthesize. Processing then moves to block 1004.

In block 1004, the user clicks on a GUI button and the text is sent to the TTS engine. Processing then moves to block 1006.

In block 1006, after synthesis is completed the TTS engine maintains state information related to the text sample synthesized. Processing then moves to decision block 1008.

In decision block 1008, the user makes a determination if the duration of any of the speech units in the synthesized sample is too long. If the result is in the affirmative, that is the duration is too long, then processing moves to block 1018. If the result is in the negative, that is the duration is not too long, then processing moves to decision block 1009.

In decision block 1009, the user makes a determination if the duration of any of the speech units in the synthesized sample is too short. If the result is in the affirmative, that is the duration is too short, then processing moves to block 1019. If the result is in the negative, that is the duration is not too short, then processing moves to decision block 1010.

In decision block 1010, the user makes a determination as to whether or not the pitch of any of the speech units in the synthesized sample is too high. If the result is in the affirmative, that is pitch is too high, then processing moves to block 1020. If the result is in the negative, that is the pitch is not too high, then processing moves to decision block 1011.

In decision block 1011, the user makes a determination as to whether or not the pitch of any of the speech units in the synthesized sample is too low. If the result is in the affirmative, that is pitch is too low, then processing moves to block 1021. If the result is in the negative, that is the pitch is not too low, then processing moves to decision block 1012.

In decision block 1012, the user makes a determination as to whether or not the user wants to mark a speech unit or multiple speech units as 'bad'. If the result is in the affirmative, that is the user wants to mark a speech unit as 'bad', then processing moves to block 1014. If the result is in the negative, that is the user does not want to mark a speech unit as 'bad', then processing moves to decision block 1016.

In block 1014, the user marks certain speech units 'bad'. In this regard, the TTS engine sets a flag on the marked 'bad' units. During unit search, when the sample is re-synthesized, all the speech units marked 'bad' will be ignored. Processing then moves to decision block 1016.

In decision block 1016, a determination is made as to whether or not the user wants to re-synthesize the text with any edits included. If the result is in the affirmative, that is the user wants to re-synthesize, then processing returns to block 1002. If the result is in the negative, that is the user does not want to re-synthesize, then the routine is exited where the user is satisfied with the output synthesis sample.

In blocks 1018 and 1019, the cost function is modified to penalize units that have durations that are too long or too short as determined by the user's preferences. As an example and not a limitation, a user can indicate to the software application that the duration of some of the speech units in the synthesized speech sample are too long. The software application will then change the cost function to more heavily penalize speech units of longer duration when the text is next re-synthesized. Processing then moves to decision block 1010.

In blocks 1020 and 1021, the cost function is modified to penalize units that have pitches that are too low or too high as determined by the user's preferences. As an example and not a limitation, a user can indicate to the software application that the pitches of some of the speech units in the synthesized sample are too low. The software application will then change the cost function to more heavily penalize speech units of lower pitch when the text is next re-synthesized. Processing then moves to decision block 1012.

Figure 5:
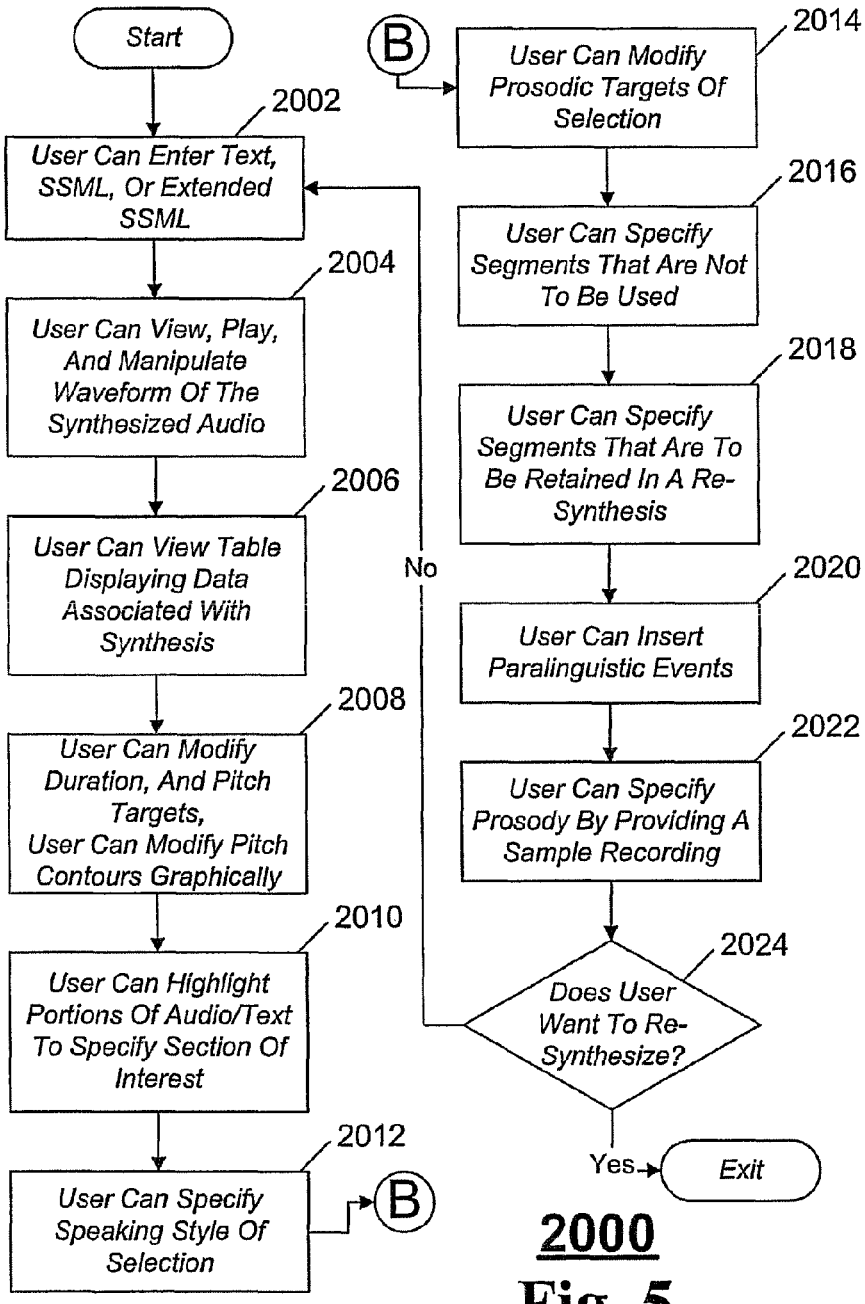
FIG. 5 illustrates one example of a routine 2000 for inputting user text, synthesizing audio, modifying the speech unit selection process including using advanced editing features, and re-synthesizing audio as needed.

Referring to FIG. 5, there is illustrated one example of a routine 2000 for inputting user text, synthesizing audio, editing the synthesized audio including using advanced editing features, and re-synthesizing audio as needed. In this exemplary embodiment, a user can specify a speaking style by highlighting a section of the graphed data and then selecting the desired and or required style. This results in the text being converted to SSML with prosody-style tags. One example is illustrated in FIG. 3. Routine 2000 illustrates one example of how such editing can be accomplished by a user of the software application. Processing starts in block 2002.

In block 2002, the graphical user interface (GUI) allows the user to enter text, SSML, and or extended SSML that the user wishes to have the text-to-speech (TTS) engine synthesize. Processing then moves to block 2004.

In block 2004, a user can view, play, and manipulate the waveform of the synthesized audio. Processing then moves to block 2006.

In block 2006, a user can view a table displaying the data associated with the synthesis. As an example, data displayed can include target pitch, target duration, selected unit pitch, duration of target, and/or other types and kinds of data. Processing then moves to block 2008.

In block 2008, a user can modify the synthesized sample pitch, and/or duration targets. Processing then moves to block 2010.

In block 2010, a user can highlight a portion of the audio, text, SSML, and/or extended SSML to specify a section of interest. Processing then moves to block 2012.

In block 2012, a user can specify the speaking style of the selection. Such speaking styles can include, for example and not limitation, apologetic. Processing then moves to block 2014.

In block 2014, a user can modify the prosodic targets of the selected section of interest. Processing then moves to block 2016.

In block 2016, a user can specify segments of the text, SSML, extended SSML, and/or synthesized speech sample that are not to be used in future playback and or re-synthesis. Processing then moves to block 2018.

In block 2018, a user can specify segments of text, SSML, extended SSML, and/or synthesized speech that are to be used in future playback and/or re-synthesis. Processing then moves to block 2020.

In block 2020, a user can insert paralinguistic events into the text, SSML, extended SSML, and/or synthesized speech sample. Such paralinguistic events can include, for example and not limitation, breath, cough, sigh, laugh, throat clear, and/or sniffle to name a few. Processing then moves to block 2022.

In block 2022, a user can specify prosody by providing a sample recording. This can allow both experienced and inexperienced users to use voice samples to fine tune the software application prosody settings and then apply the settings to other text, SSML, and extended SSML input. Processing then moves to decision block 2024.

In decision block 2024, a determination is made as to whether or not the user wants to re-synthesize the text with any edits included. If the result is in the affirmative, that is the user wants to re-synthesize, then processing returns to block 2002. If the result is in the negative, that is the user does not want to re-synthesize, then the routine is exited where the user can further work with the output synthesis sample and/or data.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method of tuning synthesized speech, comprising:

synthesizing, by a text-to-speech engine, user supplied text to produce synthesized speech;

receiving, by the text-to-speech engine, a user indication of segments of the user supplied text and/or the synthesized speech to skip during re-synthesis of the speech; and re-synthesizing, by the text-to-speech engine, the speech based on the user indicated segments to skip.

2. A method of tuning synthesized speech as defined in claim 1, further comprising receiving a user modification of duration cost factors associated with the synthesized speech to change the duration of the synthesized speech, wherein re-synthesizing the speech includes re-synthesizing the speech based on the user modified duration cost factors.

3. A method of tuning synthesized speech as defined in claim 2, wherein receiving a user modification of duration cost factors includes modifying a search of speech units when the user supplied text is re-synthesized to favor shorter speech units in response to user marking of any speech units in the synthesized speech as too long and modifying the search of speech units to favor longer speech units in response to user marking of any speech units in the synthesized speech as too short.

4. A method of tuning synthesized speech as defined in claim 1, further comprising receiving a user modification of pitch cost factors associated with the synthesized speech to change the pitch of the synthesized speech, wherein re-synthesizing the speech includes re-synthesizing the speech based on the user modified pitch cost factors.

5. A method of tuning synthesized speech as defined in claim 1, further comprising displaying a waveform associated with the synthesized speech and receiving a user manipulation of the waveform, wherein re-synthesizing the speech includes re-synthesizing the speech based on the user manipulation of the waveform.

6. A method of tuning synthesized speech as defined in claim 1, wherein the user supplied text includes plain text, speech synthesis mark-up language (SSML), or extended SSML.

7. A method of tuning synthesized speech as defined in claim 1, further comprising adding a paralinguistic event to the user supplied text and/or the synthesized speech.

8. A method of tuning synthesized speech as defined in claim 1, further comprising adding a user-specified speaking style to the user supplied text and/or the synthesized speech, wherein re-synthesizing the speech includes re-synthesizing the speech based on the user-specified speaking style.

9. A method of tuning synthesized speech as defined in claim 1, further comprising receiving a sample recording to provide prosody, wherein re-synthesizing the speech includes re-synthesizing the speech based on the sample recording.

10. A method of tuning synthesized speech as defined in claim 1, further comprising maintaining state information relating to the synthesized speech and receiving a user modification of the state information.

11. A computer-readable storage device encoded with computer-executable instructions that, when executed by a computing machine, perform a method of tuning synthesized speech comprising:

synthesizing user supplied text to produce synthesized speech;

receiving a user indication of segments of the user supplied text and/or the synthesized speech to skip during re-synthesis of the speech; and re-synthesizing the speech based on the user indicated segments to skip.

12. A computer-readable storage device as defined in claim 11, wherein the method further comprises receiving a user modification of duration cost factors associated with the synthesized speech to change the duration of the synthesized speech, wherein re-synthesizing the speech includes re-synthesizing the speech based on the user modified duration cost factors.

13. A computer-readable storage device as defined in claim 12, wherein receiving a user modification of duration cost factors includes modifying a search of speech units when the user supplied text is re-synthesized to favor shorter speech units in response to user marking of any speech units in the synthesized speech as too long and modifying the search of speech units to favor longer speech units in response to user marking of any speech units in the synthesized speech as too short.

14. A computer-readable storage device as defined in claim 11, wherein the method further comprises receiving a user modification of pitch cost factors associated with the synthesized speech to change the pitch of the synthesized speech, wherein re-synthesizing the speech includes re-synthesizing the speech based on the user modified pitch cost factors.

15. A computer-readable storage device as defined in claim 11, wherein the method further comprises displaying a waveform associated with the synthesized speech and receiving a user manipulation of the waveform, wherein re-synthesizing the speech includes re-synthesizing the speech based on the user manipulation of the waveform.

16. A computer-readable storage device as defined in claim 11, wherein the user supplied text includes plain text, speech synthesis mark-up language (SSML), or extended SSML.

17. A computer-readable storage device as defined in claim 11, wherein the method further comprises adding a paralinguistic event to the user supplied text and/or the synthesized speech.

18. A computer-readable storage device as defined in claim 11, wherein the method further comprises adding a user-specified speaking style to the user supplied text and/or the synthesized speech, wherein re-synthesizing the speech includes re-synthesizing the speech based on the user-specified speaking style.

19. A computer-readable storage device as defined in claim 11, wherein the method further comprises receiving a sample recording to provide prosody, wherein re-synthesizing the speech includes re-synthesizing the speech based on the sample recording.

20. A computer-readable storage device as defined in claim 11, wherein the method further comprises maintaining state information relating to the synthesized speech and receiving a user modification of the state information.

* * * * *